US005875784A

United States Patent [19]

Allison

[11] Patent Number: 5,875,784

[45] Date of Patent: Mar. 2, 1999

[54] TELESCOPING HOLDING SYSTEM FOR TOBACCO PIPES

[76] Inventor: Jon P. Allison, P.O. Box 1003, Timonium, Md. 21093

[21] Appl. No.: 957,703

[22] Filed: Oct. 24, 1997

[51] Int. Cl.[6] ..... A24F 7/02

[52] U.S. Cl. ..... 131/192; 131/181; 131/214

[58] Field of Search ..... 131/192, 222, 131/214, 218, 181, 198.1; 294/19.1, 19.2; 403/104

[56] References Cited

U.S. PATENT DOCUMENTS

| | | | |
|---|---|---|---|
| 33,225 | 9/1861 | Marshall . | |
| 85,626 | 1/1869 | Waite . | |
| D. 142,922 | 11/1945 | Von Rosenberg . | |
| 191,544 | 6/1877 | Oberg . | |
| 645,399 | 3/1900 | King . | |
| 1,126,255 | 1/1915 | Moses . | |
| 1,493,236 | 5/1924 | Birchall . | |
| 1,662,762 | 3/1928 | Tate, Sr. . | |
| 1,780,936 | 11/1930 | Nurnberg . | |
| 1,931,510 | 10/1933 | Rinehart . | |
| 2,145,910 | 2/1939 | Alpen . | |
| 2,772,680 | 12/1956 | Rehfeld . | |
| 3,113,575 | 12/1963 | Creuziger . | |
| 3,669,427 | 6/1972 | Curtis . | |
| 3,709,620 | 1/1973 | Miyamoto . | |
| 3,863,649 | 2/1975 | Scharfy . | |
| 3,922,027 | 11/1975 | Nesselt | 294/19 A |
| 4,589,427 | 5/1986 | Baynes | 131/181 |
| 4,659,125 | 4/1987 | Chuan | 294/19.2 |
| 4,845,876 | 7/1989 | Dodson . | |
| 5,188,409 | 2/1993 | Forey . | |

*Primary Examiner*—John G. Weiss
*Assistant Examiner*—Charles W. Anderson
*Attorney, Agent, or Firm*—Rosenberg, Klein & Bilker

[57] ABSTRACT

A telescopically extendable holder is removably attached to the tobacco pipe and supports the tobacco pipe a desired distance from a pipe smoker. The telescopically extendable holder includes a telescoping shaft having saleable members and connection elements adapted to removably attach the distal end of the telescoping shaft to the tobacco pipe in parallel to the stem of the pipe. The telescopically extendable holder is also adapted to support a cigar or a cigarette. A pocket clip is provided for clipping the holder to the apparel of the smoker. When disassembled, the connecting elements may be kept in the handle attached to a proximal end of the telescopic shaft.

18 Claims, 4 Drawing Sheets

TELESCOPING HOLDING SYSTEM FOR TOBACCO PIPES

FIELD OF INVENTION

The present invention relates to holders for tobacco products, and more particularly, to telescopically extendable holders integrated into tobacco pipes to be used by a pipe smoker experiencing difficulties in movement for reaching a remote ash tray to remove ash from the tobacco pipe.

BACKGROUND OF THE INVENTION

Description of Prior Art

Tobacco pipes are well known in the art. Pipes generally include a receptacle adapted to receive a measured amount of tobacco and a stem piece which is hollow and has an end conveniently held in the mouth of the user. Another end of the stem is connectable to the receptacle so that, being in fluid communication with the receptacle, is capable of transmitting the products of combustion of the tobacco burned in the receptacle to the mouth of the user. The stem of a tobacco pipe can be, if desired, adjusted in length. For example, U.S. Pat. Nos. 33,225; 191,544; and 3,863,649 describe tobacco pipes, the stems of which include telescopically moveable members which are capable of telescopic sliding one within the other for reasons of length adjustment of the stem. These telescoping stems, however, do not constitute supporting or holding structures for pipes, but quite to the contrary, are integral to the pipes, and cannot be removed from the tobacco pipe without impeding the pipe to serve the purposes intended.

Cigar or cigarette holders are also known in the art. For instance, U.S. Pat. No. 645,399 is directed to a cigar or cigarette holder which is formed by a plurality of tubular sections which are telescopingly joined. The telescoping arrangement of tubes is intended to carry the smoke from the burning tobacco to the user's mouth, thereby influencing the process, and therefore does not define a mere handle or mere support for the cigarette (or a cigar) which would extend in spaced relation with a passage for product of tobacco combustion, without any interference with the smoking process.

It is sometimes desirable for a pipe smoker to have an extendable holder for a tobacco pipe which may be removably integrated into the pipe in order to reach a remote location. For instance, if the pipe smoker was injured, and thereby experiences movement difficulties, he (or she) would need an extendable holder for the pipe which would facilitate the user to reach an ash tray located at a remote distance for removing ash from the pipe. This holder must constitute a separate device capable of being removable attached to a tobacco pipe, cigar, or cigarette without interfering with inherent smoke passages of tobacco products.

SUMMARY OF THE INVENTION

It is therefore an object of the present invention to provide a support or handle structure capable of being removably integrated into the tobacco pipe and telescopically extended for aiding displacement of the tobacco pipe, as a whole, towards a desired location.

It is another object of the present invention to provide a universal pipe holder, capable of holding any tobacco product (pipe, cigar or a cigarette), for the purpose of reaching any desired remote location for ash removal.

It is still an object of the present invention to provide a pipe holder comprising a telescopingly extendable member and a set of interchangeable connection parts interconnecting the telescopingly extendable member and a tobacco pipe ( or cigar, or cigarette), and further having a handle constituting a convenient receptacle for accommodating the connection parts therein.

It is a further object of the present invention to provide a telescopingly extendable handle for a tobacco pipe, which could be conveniently attached to a smoker's apparel, for instance to a pocket thereon.

According to the teaching of the present invention, a telescopingly extendable holder is removably attached to a tobacco pipe for supporting the tobacco pipe a desired distance from a pipe smoker. The holder comprises a telescoping shaft which may include two or more telescopically saleable members, and connection means adapted to removably attach the distal end of the telescoping shaft to the tobacco pipe.

Preferably, the connection mechanism includes a set of female/male snaps, swivel rod (or connector male snap), bowl male and female snap, and alternatively, resilient clamp member, for connecting the telescopingly extendable holder to the tobacco pipe essentially in parallel to the stem of the tobacco pipe, and spaced therefrom.

In one of the embodiments, the pipe holder is provided with a clamp which serves for holding a cigar or a cigarette for the same purpose of reaching a remote ash tray in order to remove ash from the cigar/cigarette.

Preferably, a pocket clip is removably attached to the proximal end of the telescoping shaft so that the holder can be attached to the user's apparel. In a preferred embodiment thereof, the pipe holder also may include a handle with a lid. The handle has an internal cavity providing a room for the connection parts set. The handle may be attached to the proximal end of the telescoping shaft or to the pocket clip mounted on the telescoping shaft.

These and other novel features and advantages of this invention will be fully understood from the following detailed description and the accompanying drawings.

A BRIEF DESCRIPTION OF THE DRAWINGS

DESCRIPTION OF THE PREFERRED EMBODIMENTS

Figure 1:
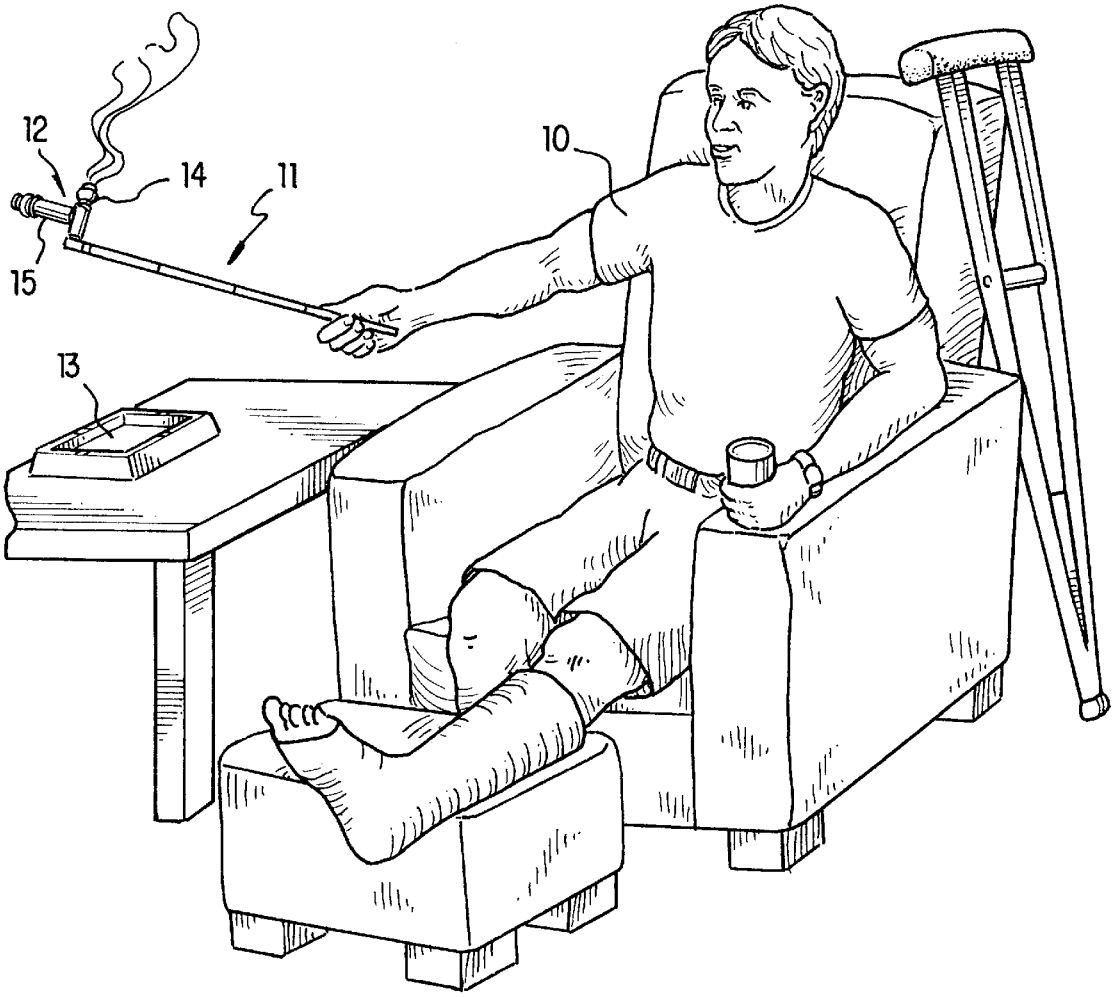
FIG. 1 is a perspective view showing a user reaching the ash tray with the help of a telescopical holder integrated into the tobacco pipe.

Referring to FIG. 1, a smoker 10, who experiences difficulties in movement, uses a telescopically extendable holder 11 attached to a tobacco pipe 12 for reaching a ash tray 13 in order to remove the ash from the pipe 12.

Figure 2A:
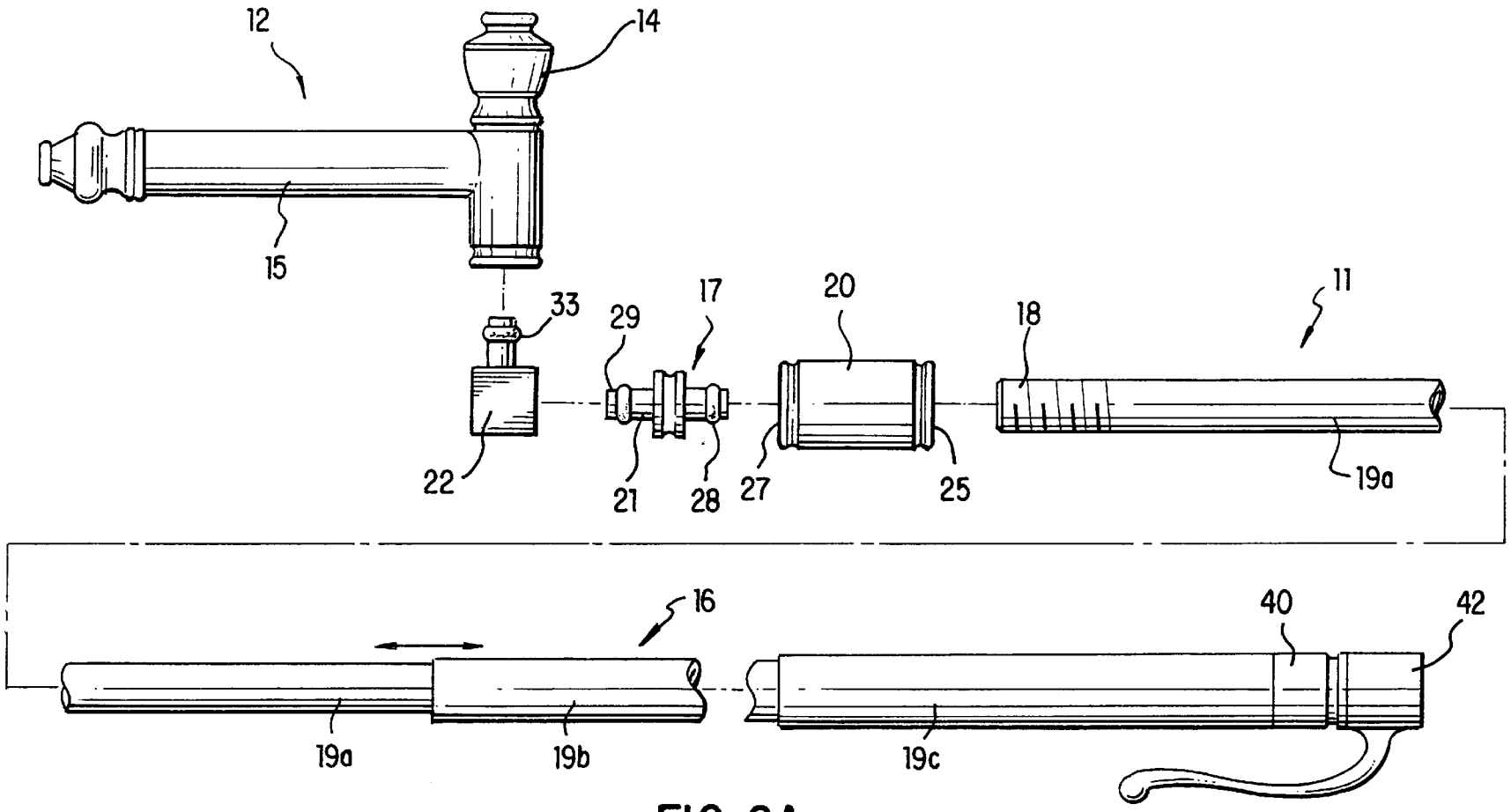
FIG. 2 is an exploded view, partially cut-away of the telescopically extendable holder including a tobacco pipe, connecting parts, and telescoping shaft of the present invention.
FIG. 2B is a partially sectioned view of the connecting mechanism according to one embodiment of the present invention.
Figure 2B:
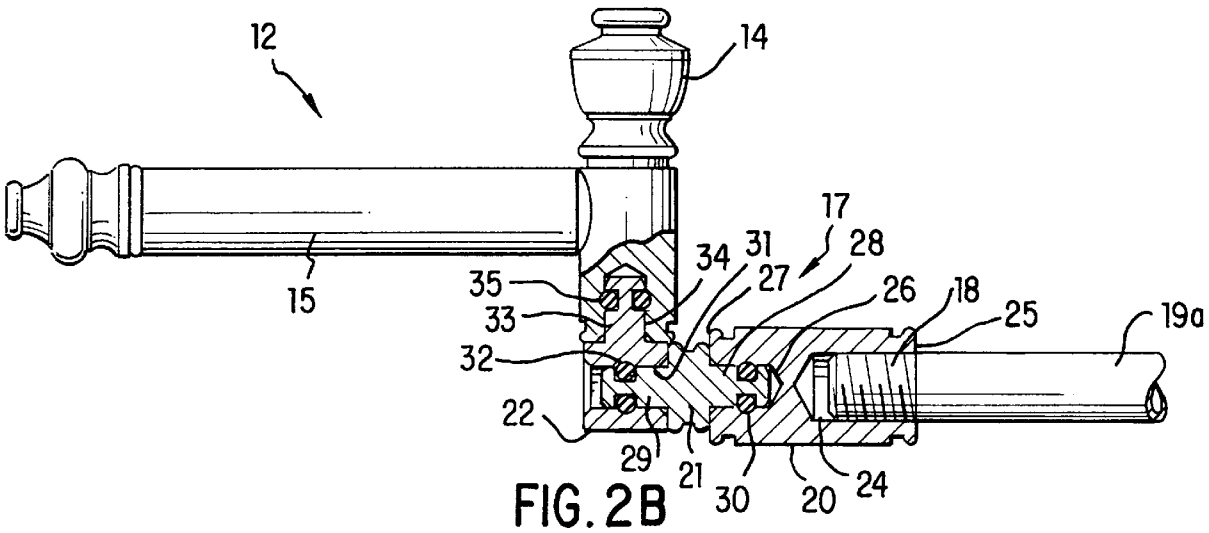
Figure 3:
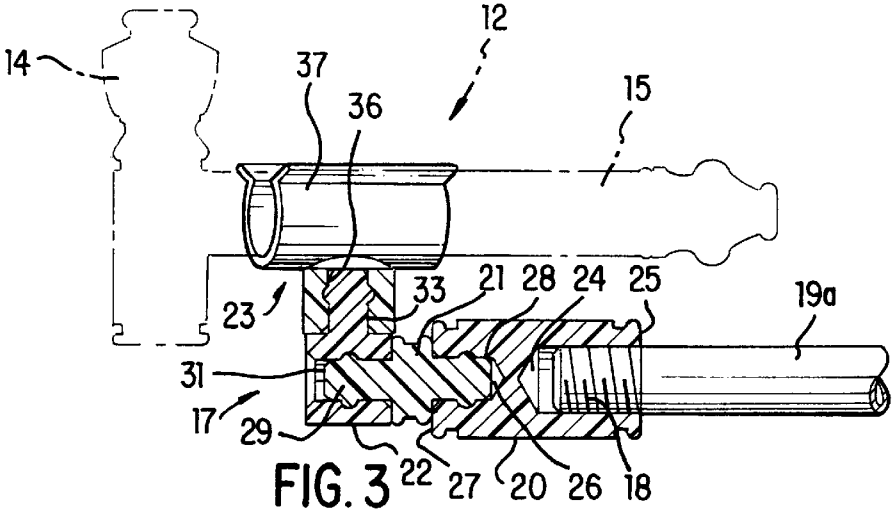
FIG. 3 is a partially sectioned view of connection mechanism according to another embodiment of the present invention.

Referring to FIGS. 1–3, the tobacco pipe 12 includes a bowl 14 and a stem 15. The bowl 14 is adapted to receive a measured amount of tobacco and the stem 15 is hollow providing a through opening and is adapted to have one end held in the mouth by the smoker 10 and an opposing end connectable to the bowl 14 in fluid communication therewith. This end is in fluid communication with the bowl 14 so that the products of combustion are transmitted to the mouth of the smoker 10 at his (or her) option.

The tobacco pipe 12 is a conventional tobacco pipe and does not need to be modified or adapted for being used in conjunction with the telescopically extendable holder 11 of the present invention, with the exception of a slight modification needed for connection thereto of the telescopically extendable holder 11 in the first preferred embodiment shown in FIG. 2B, discussed in detail in following paragraphs.

The telescopically extendable holder 11 includes a telescoping shaft 16 and a set of connecting elements 17 adapted to removably attach a distal end 18 of the telescoping shaft 16 to the tobacco pipe 12. The telescoping shaft 16, as best shown in FIG. 2A, includes telescopically saleable members 19*a*, 19*b*, and 19*c*, which are hollow tubular pieces formed of a metal, such as brass or some other light material composition, the members 19*a*, 19*b*, and 19*c* have generally uniform wall thickness; each of them, however, has preselected distinct diameter in order to permit each member, for instance 19*a*, to slidably but snugly fit within the member 19*b*, and for member 19*b* slidably and snugly fit within the member 19*c*.

The saleable member 19*a* may also be fabricated as a tube member without a hollow therewithin. It is to be understood by those skilled in the art that the telescoping shaft 16 may have any number of saleable members but not less than two. The distal end 18 of the telescoping shaft 16 coincides with the distal end of the saleable member 19*a* and is coupled thereto. Distal end 18 may be smooth or may have threads provided thereon for the purposes described further herein.

The set of connecting elements 17 includes a female quick release/connect snap (or pipe connector) 20, a swivel rod (or connector male snap) 21, a bowl male and female snap 22, and a resilient clamp member 23. The pipe connector 20 has, as best shown in FIGS. 2B and 3, two bores: a bore 24 on the side 25 of the pipe connector 20 and a bore 26 on the side 27 of the pipe connector 20. The distal end 18 of the saleable member 19*a* is received within the bore 24 of the pipe connector 20 and is held therein either by snap action of engaged bore 24 and distal end 18 or by means of threads provided on the distal end 18 and within the bore 24. The swivel rod (or connector male snap) 21 has a pair of male snaps 28 and 29. The male snap 28 is received within the bore 26 of the pipe connector 20. An O-ring 30 facilitates in retaining the male snap 28 in the bore 26.

The bowl male and female snap 22 has a through bore 31, receiving the male snap 29 of the swivel rod 21. An O-ring 32 facilitates in retaining the male snap 29 within the bore 31. As it is understood by those skilled in the art, the through bore 31 of the bowl male and female snap 22 constitutes a female quick connect/disconnect snap from both sides of the bowl male and female snap 22. The bowl male and female snap 22 also has a male quick connect/disconnect snap 33 extending substantially in a perpendicular direction to the bore 31. The male snap 33 is received within the pipe bowl female snap 34 made in the tobacco pipe as shown in FIG. 2B (the pipe bowl female snap 34 is the only modification made to the conventional tobacco pipe 12 needed for being used with the telescopic extendable holder 11 of the present invention). O-ring 35 is provided for holding the female snap 34 and male snap 33 in coupled relation to each other. As it is best shown in FIG. 2B, the saleable member 19*a*, the pipe connector 20, and the swivel rod 21 are interconnected in longitudinal coaxial arrangement thereof, which, as the whole, is further supported substantially perpendicular to the pipe bowl female snap 34 of the tobacco pipe 12. The connection arrangement shown in FIG. 2B, provides for telescoping shaft 16 disposed in substantial parallel mutual interposition with the stem 15 of the tobacco pipe 12.

In another embodiment of the present invention, best shown in FIG. 3, the conventional tobacco pipe 12 does not need to be subject of any modifications for being used with the telescoping extendable holder 11. For this embodiment, the set of connecting elements 17 includes the pipe connector 20, swivel rod 21, and the bowl male and female snap 22 similar to those shown in FIG. 2B and previously described. Additionally, the clamp member 23 is provided which has a clamp extension 36 and a resilient clamp member 37. The clamp extension 36 receives a male snap 33 of the bowl male and female snap 22, thereby holding the longitudinal coaxial structure (saleable member 19*a*, pipe connector 20, and the swivel rod 21) attached to the clamp member 23. The resilient clamp member 37 constitutes a semi-circular pipe holder having a C-shaped cross-section which resiliently embraces the stem 15 of the tobacco pipe 12 and retains the stem in the cavity formed by the semi-circular resilient pipe holder. As best shown in FIG. 3, the telescoping shaft 16 is held substantially in parallel and below the stem 15 of the tobacco pipe 12.

As it is best shown in FIGS. 2B and 3, the connection elements shown in FIG. 2B may be made of metal, while the connection elements shown in FIG. 3 may be made of plastic or some like composition. Due to the better plasticity of the plastic connecting elements, O-rings which are used for the structure shown in FIG. 2B, are not needed for the structure shown in FIG. 3.

Figure 4:
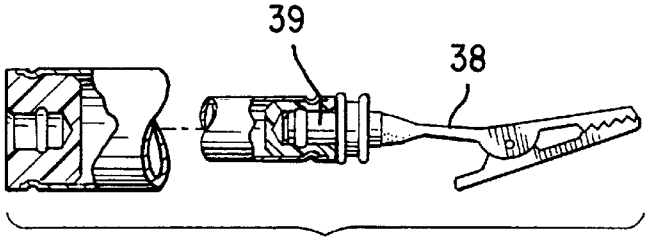
FIG. 4 is an exploded, partially sectioned view of an alternative embodiment of the present invention providing an alligator clamp for holding a cigar or cigarette.

Referring to FIG. 4, a clamp 38 (for instance, alligator connector) is provided for being secured to the distal end of the saleable member 19*a* for holding a cigar or a cigarette if this tobacco product is in use. The clamp 38 is provided with a male quick release/connect snap 39 which is received within a female snap provided on the distal end 18. This female snap may be a bore 26 of the pipe connector 20 attached to the distal end 18, or the male snap 39 of the clamp 38 may be inserted into the through bore 31 of the bowl male and female snap 22.

Figure 5:
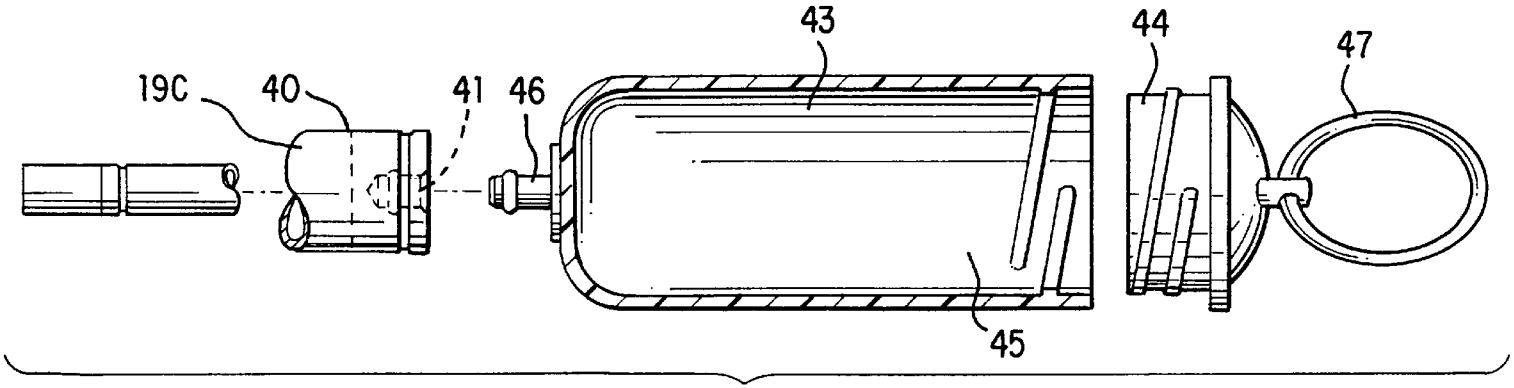
FIG. 5 is an exploded longitudinally sectioned view of a handle assembly provided for being connected to the proximal end of the telescoping shaft.
Figure 6:
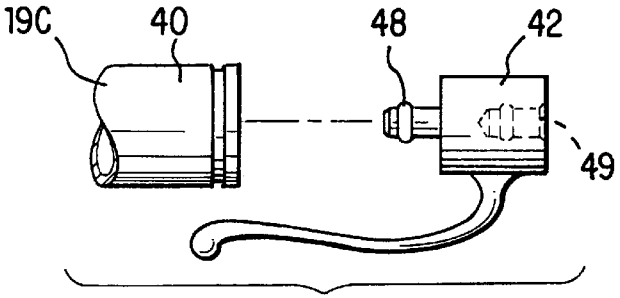
FIG. 6 is an exploded view of a pocket clip for being attached to the proximal end of the telescoping shaft.

As best shown in FIGS. 5 and 6, the proximal end 40 of the saleable member 19*c* has a female snap 41, which may be used for two purposes: for providing connection to a pocket clip 42, as best shown in FIG. 6; or for providing connection to a handle 43 as best shown in FIG. 5. The handle 43 has a lid 44 removably attached to the handle 43 by any means known to those skilled in the art, but preferably threadingly. A cavity 45 is provided within the handle 43 for the purposes of accommodating connection elements 17 when desired by the user 10. A male snap 46 engages the female snap 41, thereby interconnecting the handle 43 and the telescopically extendable holder 11. A key ring 47, as desired, may be provided on the lid 44 of the handle 43. The handle 43 is very convenient for the smoker 10, since when the smoker 10 does not need a telescopically extendable holder 11, all connecting elements 17 may be disassembled from the holder 11 and kept within the handle 43 with the lid 44 closed thereon. When not in use, the telescoping shaft 16 then will have its saleable members 19*a*, 19*b*, and 19*c* inserted one within the other and thereby having the telescopic shaft 16 shortened to the length of the saleable member 19*c*.

The pocket clip 42 has a male snap 48 and female snap 49. The male snap 48 is engaged within the female snap 41 of the proximal end 40 when the pocket clip 42 is desired to be attached to the telescopically extendable holder 11.

The pocket clip 42 serves for attaching the telescopically extendable holder 11 to apparel of the smoker 10, for instance to a pocket of the apparel. The female snap 49 may be used to receive the male snap 46 of the handle 43, if such a structure is desired. This structure is not shown in drawings, however, it will be understood by those skilled in the art that once the pocket clip 42 is directly attached to the proximal end 40 of the telescoping shaft 16, the handle 43 may be directly attached to the pocket clip 42 by engaging the male snap 46 to the female snap 49.

In use, the connecting elements 17 are removed from the handle 43, and assembled according to FIG. 2B or 3, as desired, then the telescoping shaft 16 is extended a length sufficient to cover the distance from the smoker 10 to the desired destination, for instance ash tray 13. Then, in order to remove the ash from the pipe, the smoker 10 extends the holder 11 towards the ash tray 13 and slightly rotates the pipe 12 so that the ash falls down from the bowl 14. If used for holding a cigar or a cigarette, the clamp 38 is attached to the telescoping shaft 16, as shown in FIG. 4, and the holder 11 is manipulated as previously discussed.

As is readily understandable from the above discussion, the telescopically extendable holder for tobacco products is a convenient device for use by smokers having difficulties in mobility, or by a person who may have physical problems in changing position and needs to reach the ash tray from the location where the smoker is comfortably and conveniently positioned.

The telescopically extendable holder 11 of the present invention provides a universal means to be used with tobacco pipes, cigars, cigarettes and which can be attached to the apparel of the smoker, and which has means (handle) where connecting elements may be kept when the telescopically extendable holder 11 is not in use. The versatility of the telescopically extendable holder 11 is achieved by employing a set of interchangeable connecting and snapping elements which can be used in many desired combinations thereof.

Although this invention has been described in connection with specific forms and embodiments thereof, it will be appreciated that various modifications other than those discussed above may be resorted to without departing from the spirit or scope of the invention. For example, equivalent elements may be substituted for those specifically shown and described, certain features may be used independently of other features, and in certain cases, particular locations of elements may be reversed or interposed, all without departing from the spirit or scope of the invention as defined in the appended claims.

What is claimed is:

1. A telescopically extendable holder for supporting at a predetermined distance from a smoker a tobacco product, said holder comprising:

(a) a tobacco pipe having a pipe stem and a pipe bowl in fluid combination each with respect to the other, said tobacco pipe including a first snap coupling formed therein;

(b) a telescoping shaft coupled to said tobacco pipe and having at least a pair of telescopically displaceable sliding members, said telescoping shaft having opposing distal and proximal ends; and, (c) connection means for removably attaching said distal end of said telescoping shaft to said tobacco pipe, said connection means including a second snap coupling secured to said distal end of said telescoping shaft and a third snap coupling releasably engageable with said second snap coupling on one end thereof and releasably engageable with said first snap coupling;

whereby said tobacco pipe is supported, responsive to said telescopic displacement of said sliding members, in selectively spaced relation to said telescoping shaft proximal end.

2. The telescopically extendable holder of claim 1, further including a pocket clip removably attached to said proximal end of the telescoping shaft, said proximal end of the telescoping shaft having a female snap, said pocket clip including a body provided with a male snap engaging said female snap at the proximal end of the telescoping shaft.

3. The telescopically extendable holder of claim 1, further including a handle and a lid removably attached to the handle, said handle having an internal cavity providing an enclosure for said connection means, said proximal end of the telescoping shaft having a female snap, said handle further having a male snap engaging a female snap at the proximal end of the telescoping shaft.

4. The telescopically extendable holder of claim 2, further including a handle provided with a male snap, wherein said body of the pocket clip further includes a female snap at a side thereof opposite to the male snap, said male snap on the handle engaging said female snap on the body of the pocket clip.

5. A telescopically extendable holder adapted for removable attachment to a tobacco product, said holder comprising:

(a) a tobacco pipe having a pipe stem and a pipe bowl in fluid combination each with respect to the other, said tobacco pipe including a female snap coupling formed therein;

(b) a telescoping shaft releasably coupled to said tobacco pipe and having at least a pair of telescopically sliding members, said telescoping shaft having opposing distal and proximal ends; and, (b) connection means for removably attaching said distal end of said telescoping shaft to said female snap coupling of said tobacco pipe, said connection means including:

(1) a bowl male and female snap for releasable coupling to said female snap coupling of said pipe bowl, said bowl male and female snap having both a bowl male connection portion and female snap partial bore formed therein;

(2) a connector male snap having first and second opposing ends, said first end being coupled to said bowl male and female snap within said female snap partial bore; and, (3) means for coupling said connector male snap to said telescoping shaft.

6. The telescopically extendable holder as recited in claim 5, where said means for coupling includes a pipe connector member having first and second ends, said first and second ends having partial bores formed therein, said first end being coupled to said connector male snap by insert of said connector male snap second end within said partial bore of said pipe connector member first end partial bore.

7. The telescopically extendable holder as recited in claim 6 where said pipe connector member second end is threadedly secured to said telescoping shaft.

8. The telescopically extendable holder as recited in claim 6 where said pipe connector member second end is force fit to said telescoping shaft.

9. The telescopically extendable holder as recited in claim 6 where said connector male snap is rotatably secured to said bowl male and female snap and said pipe connector member on said opposing ends thereof.

10. The telescopically extendable holder as recited in claim 6 where said bowl male and female snap is rotatably secured to said pipe bowl.

11. A telescopically extendable holder adapted for removable attachment to a tobacco product, said holder comprising:

(a) a tobacco pipe having a pipe stem coupled in fluid communication with a pipe bowl;

(b) a telescoping shaft for couling to said tobacco pipe and having at least a pair of telescopically sliding members, said telescoping shaft having opposing distal and proximal ends; and, (c) connection means for removably attaching said distal end of said telescoping shaft to said tobacco pipe, said connection means including:

(1) a male and female snap having a partial bore formed therein;

(2) a connector male snap having first and second opposing ends, said first end being coupled to said male and female snap within said partial bore;

(3) means for coupling said connector male snap to said telescoping shaft; and, (4) means for releasably coupling said telescoping shaft to said pipe stem.

12. The telescopically extendable holder as recited in claim 11 where said means for releasably coupling said telescoping shaft to said pipe stem includes resilient clamping means for releasably securing said pipe stem to said telescoping shaft.

13. The telescopically extendable holder as recited in claim 12 where said resilient clamping means includes an extended clamp member having a C-shaped cross-section.

14. The telescopically extendable holder as recited in claim 13 including a clamp extension member coupled to said clamp member and having an opening formed therein for securement therein of said male and female snap.

15. The telescopically extendable holder as recited in claim 11 where said means for coupling said connector male snap to said telescoping shaft includes a pipe connector member having first and second ends, said first and second ends having partial bores formed therein, said first end being coupled to said connector male snap by insert of said second end of said connector male snap into said partial bore formed within said first end of said pipe connector member.

16. The telescopically extendable holder as recited in claim 15 where said pipe connector member second end is threadedly secured to said telescoping shaft.

17. The telescopically extendable holder as recited in claim 15 where said pipe connector member second end is force fit to said telescoping shaft.

18. The telescopically extendable holder as recited in claim 11 where said connector male snap is rotatably secured to said means for releasably coupling said telescoping shaft to said pipe stem.

* * * * *